US010233634B1

(12) United States Patent
Venturo

(10) Patent No.: US 10,233,634 B1
(45) **Date of Patent: *Mar. 19, 2019**

(54) BUILDING WALL COMPRISING STACKABLE BUILDING BLOCKS

(71) Applicant: John Joseph Venturo, Granite Falls, WA (US)

(72) Inventor: John Joseph Venturo, Granite Falls, WA (US)

( * ) Notice: Subject to any disclaimer, the term of this patent is extended or adjusted under 35 U.S.C. 154(b) by 134 days.

This patent is subject to a terminal disclaimer.

(21) Appl. No.: 15/168,245

(22) Filed: May 31, 2016

Related U.S. Application Data

(63) Continuation-in-part of application No. 12/824,360, filed on Jun. 28, 2010, now Pat. No. 9,732,519.

(51) Int. Cl.

| | |
|---|---|
| ***E04B 1/16*** | (2006.01) |
| ***E04B 2/32*** | (2006.01) |
| ***E04B 2/56*** | (2006.01) |
| ***E06B 1/36*** | (2006.01) |
| ***E06B 1/70*** | (2006.01) |
| ***E04C 2/38*** | (2006.01) |
| ***E04B 2/00*** | (2006.01) |
| ***E04B 2/38*** | (2006.01) |
| ***E04B 1/76*** | (2006.01) |
| ***E04B 1/88*** | (2006.01) |

(52) U.S. Cl.
CPC ..... *E04B 2/32* (2013.01); *E04B 1/7604* (2013.01); *E04B 1/7608* (2013.01); *E04B 1/88* (2013.01); *E04B 2/38* (2013.01); *E04B 2/56* (2013.01); *E04C 2/38* (2013.01); *E04C 2/46* (2013.01); *E06B 1/36* (2013.01); *E06B 1/702* (2013.01)

(58) Field of Classification Search
CPC ..... E04B 2/14; E04B 2/18; E04B 2/42; E04B 2/46; E04B 2/56; E04B 2/58; E04B 2/64; E04B 1/7604; E04B 1/7608; E04B 1/88; E04B 2/38; E04B 2/32; E04B 1/10; E04B 2/80; E06B 1/36; E06B 1/702; E04C 2/38; E04C 2/46; E04C 2/10; E04C 2/12
USPC ..... 52/424, 485, 426, 433, 438, 407.1, 561, 52/566, 606, 607
See application file for complete search history.

(56) References Cited

U.S. PATENT DOCUMENTS

| | | | | |
|---|---|---|---|---|
| 1,353,702 | A * | 9/1920 | Aschauer | E04B 2/28 405/273 |
| 5,623,797 | A * | 4/1997 | Gravier | E01F 8/0017 256/19 |
| 6,632,048 | B2 * | 10/2003 | Greenberg | E02D 29/0283 405/262 |
| 7,174,687 | B2 * | 2/2007 | Ferguson | E04B 2/52 52/100 |
| 9,732,519 | B1 * | 8/2017 | Venturo | E04B 2/64 |

(Continued)

*Primary Examiner* — William V Gilbert
(74) *Attorney, Agent, or Firm* — Joseph Z Ellsworth

(57) ABSTRACT

A wall comprises building blocks with opposing like outer members spaced apart by at least two risers as cross members inward from outer member ends leaving a center open with a void between the outer members and the risers. The risers extend from the bottom of the block to above the outer member tops. A continuous tongue projects upward from the top of the outer members parallel thereto along the length of the outer member and mates with grooves along the bottom of a similar outer member stackable thereon for ease of block alignment. A next stacked block is nailed to the risers projecting into its center.

20 Claims, 12 Drawing Sheets

(56) References Cited

U.S. PATENT DOCUMENTS

| | | | | |
|---|---|---|---|---|
| 2002/0007610 | A1* | 1/2002 | Abang Ali | E04B 2/44<br>52/604 |
| 2008/0256894 | A1* | 10/2008 | Marsh | E02D 27/02<br>52/719 |
| 2011/0258944 | A1* | 10/2011 | Radoane | E04B 2/58<br>52/62 |

* cited by examiner

BUILDING WALL COMPRISING STACKABLE BUILDING BLOCKS

This application is a continuation in part of application Ser. No. 12/824,360 filed on Jun. 28, 2010, and later granted as U.S. Pat. No. 9,732,519.

BACKGROUND

Field of the Invention

This invention relates to blocks for easy construction of a building, and more specifically to a building block with risers extending upward from intermediate the block into a like next vertically adjacent stacked block.

Prior Art

It is known to have blocks suitable for constructing a building. Representative of such building blocks are the following patents.

Disclosed in a patent with patent number JP05079104A issued in Japan is a building block that has a channel on top and bottom. A slat fits in a groove of a first block and extends above the block to receive a bottom channel of a next block stacked on the first block. The slat thus connects the two blocks together.

Disclosed in a patent with patent number JP2002356941A issued in Japan is a building block that has a groove central on all sides of the block.

Disclosed in a patent with patent number JP2007278046A issued in Japan is a building block that comprises two opposed face members with a plurality of opposing grooves on respective inner block sides. A slat fits in each groove between the face members joining the face members. The slats extend from a distance from the bottoms of the face members to above the face members the same distance to be received into similar grooves of a next block stacked thereon. The slats are maintained in position by nails or screws through the face members into the slats.

Disclosed in a patent with patent number U.S. Pat. No. 4,956,958 issued in the United States is a building block that has dihedral projections on an end of tops of opposing face members which mate with dihedral recessions on the opposite end of the bottom of a similar block stacked thereon so stacked blocks overlap. A cross member extends between the opposing face members also with dihedral projections. The top of the face members except for the dihedral projections are slanted or have a dihedral projection parallel with the top that mates with dihedral recessions on its bottom at an opposite end. A second cross member extends between the opposing face members and may also have dihedral projections. All of dihedral projections extend a same distance across the top of the block.

Disclosed in a patent with patent number U.S. Pat. No. 6,665,994B1 (also found in WO03104580A1) issued in the United States is a building block that has opposing face members and a cross member at each end with a third cross member central in the block between the face members. Each cross member has a recess on its top and like projections on its bottom that extend further than the depth of the recess so a first block stacks on a second block leaving a channel between the top of the second block and the bottom of the first block. The central cross member is twice the width of end cross members so blocks overlap with end of the first block stacking on the central cross member of the second block.

Disclosed in a patent with patent number US20100043335A1 is a building block that has opposing face members and a cross member at each end with a third cross member central in the block between the face members. Each cross member has a recess on its top and like projections on its bottom to mate with the top of a next stacked block. The center cross member has twice the width of the end cross members so an end s of next stack blocks mate in abutment with the central cross member.

The object of the present invention is to provide a building block with an open or void center between outer members and risers inward from block ends extending above the top of the outer members and receivable into a center of a similar block stackable thereon as a joining member. It is a further object that the outer members are self-aligning as they are mutually stacked.

SUMMARY

These objects are achieved in a building block that has opposing like outer members spaced apart by at least two risers as cross members inward from outer member ends leaving a center open with a void between the outer members and risers. The risers extend from the bottom of the block to above the outer member tops requiring a next stacked second block to be stacked in offset from the first block by at least the width of the risers as the risers of the first block extend into the center void of the second block preventing a seam on seam joint between vertically adjacent blocks of a same length when the risers are similarly located within respective blocks. The outer members are spaced apart by the risers a distance of 3¼", equal to the width of cripple, or an end member comprising 2 face to face 2×4 studs, receivable into the open center within the block at the ends of stacked blocks to close the stacked blocks such as for a door or window. The vertical cripple in the end of the wall of stacked blocks is then suitable to support a header. A continuous tongue projects upward from the top of the outer members central in the top and parallel to the outer members along the length of the respective outer members and mates with grooves along the bottom of similar respective outer members for ease of block alignment. The groove is larger than the tongue for ease of assembly leaving approximately 1/16" between each side of the tongue and the groove in which it is received. Nails or screws as fasteners attach the outer members to the risers forming the block. The risers pass from the bottom to the top of the outer members to receive fasteners, such as nails or screws, through the outer members and into the risers. Thus, a next stacked block is nailed to the risers of the block on which it is stacked, obviating the need for vertical pinning between stacked blocks. The blocks are pre-made and then easily and quickly stacked for facile construction of a wall. Each joint between abutting block ends requires a post to seal the joint. Blocks are constructed in standard block lengths of 3', 4', 5', 6', 7' and 8' for ease of construction of light weight blocks.

A further improvement in the field of wall construction is a method and apparatus for anchoring the block wall to a foundation. Anchor bolts can be cured into a concrete foundation. A recess is routered in the top of adjacent outer members configured to fit an anchor plate that spans across the void center and the anchor bolt is fastened to it.

Advantageously, a corner post may be inserted in the void center at a corner where two walls meet. Driving a corner post into the corner immediately lines up all the blocks for a planar wall that is pleasing to look at.

Further, due the walls being hallow or having a void center, they need to be closed out at all interfaces with doors and windows. This requires close out boards being put in the voids flush with the vertical edge of an opening to make a flush surface.

Corners and seams around doors and windows can be wrapped with wood to improve appearance.

DETAILED DESCRIPTION OF THE PREFERRED EMBODIMENT

Figure 1:
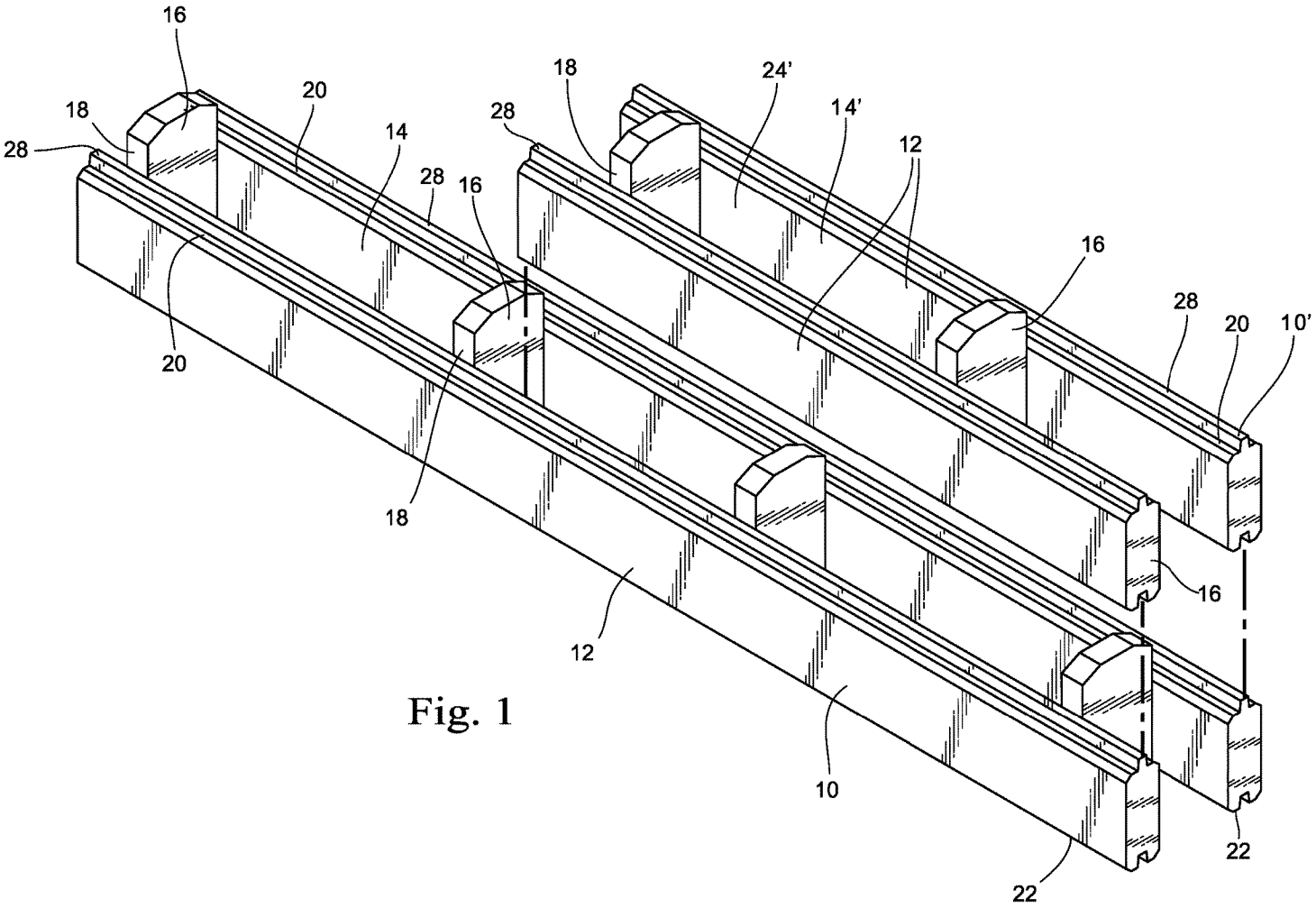
FIG. 1 is a perspective view of a block of the present invention aligned for stacking on a similar second block.
Figure 2:
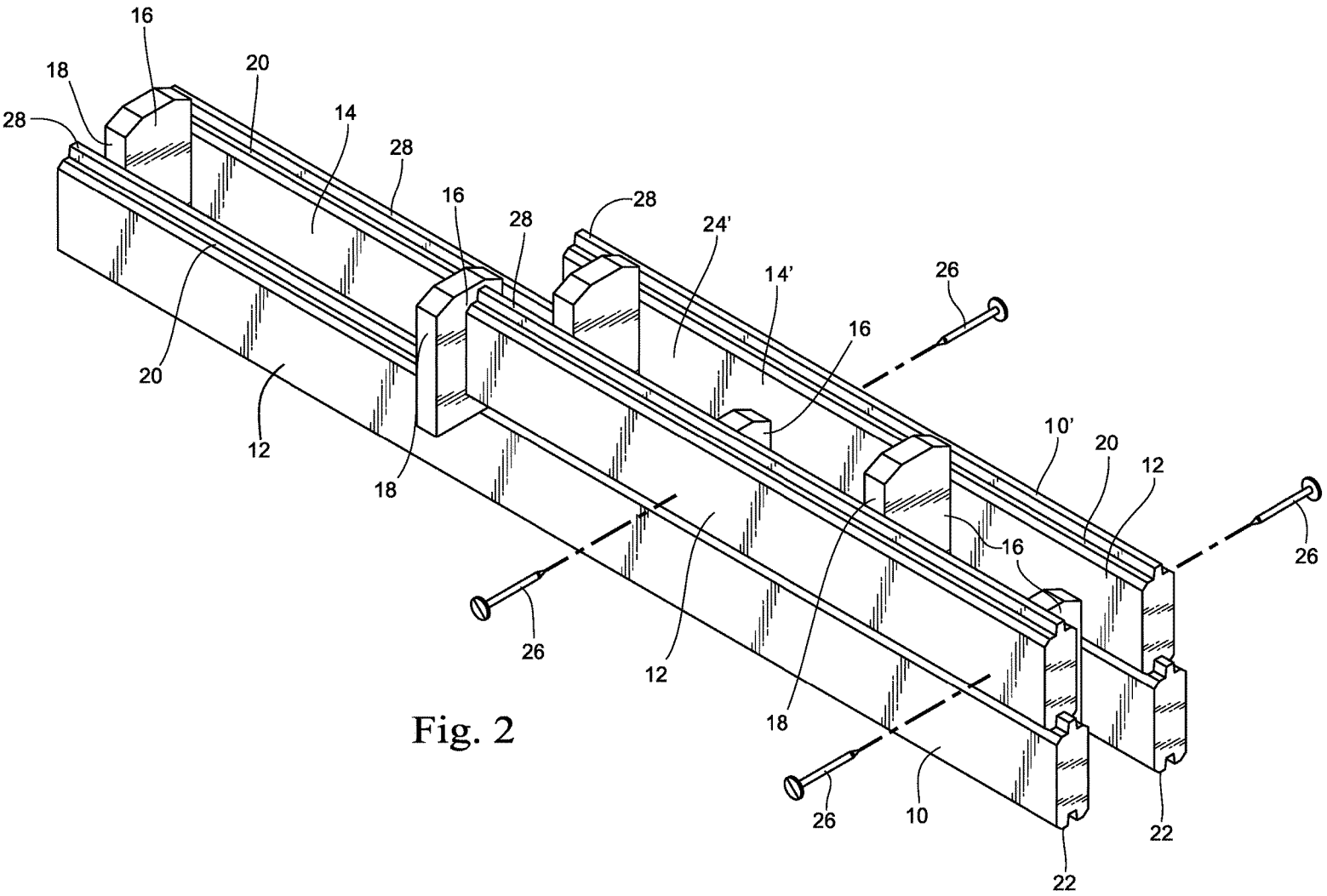
FIG. 2 is a perspective view of the blocks of FIG. 1 stacked together.
Figure 3:
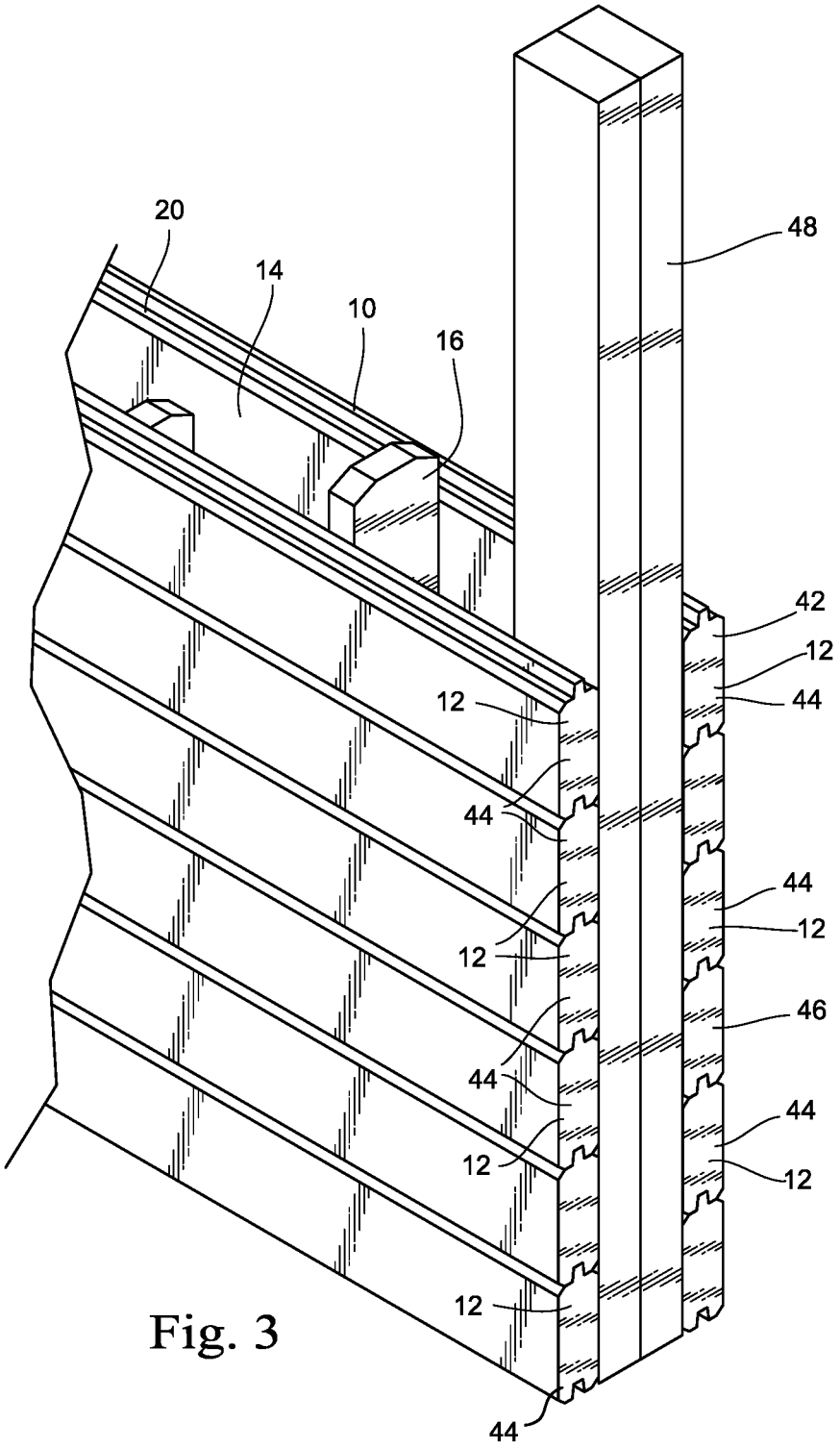
FIG. 3 is a perspective view of a stack of blocks of the invention forming a partial wall together with a vertical end post within the ends of the blocks.
Figure 4:
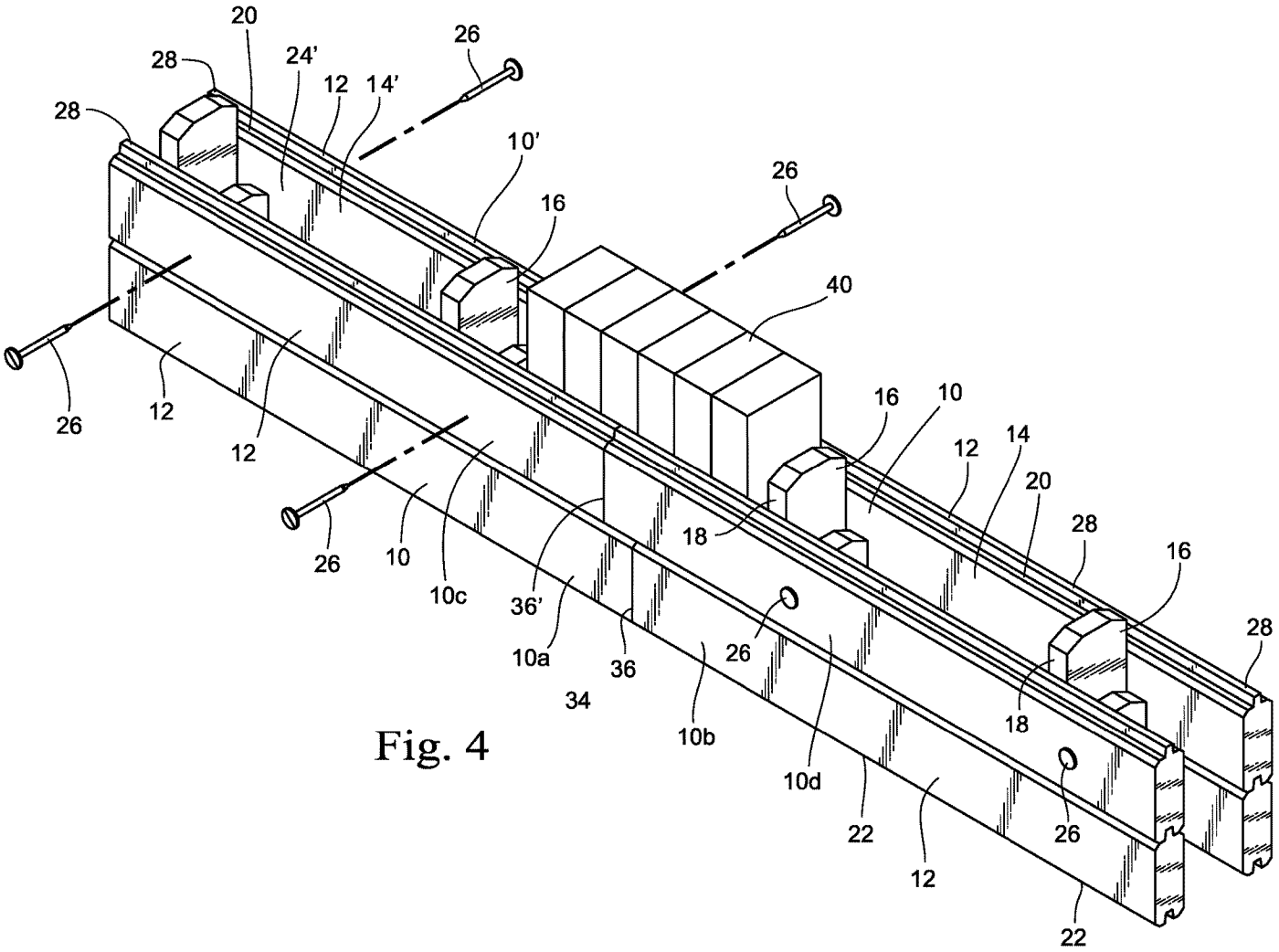
FIG. 4 is a perspective view showing two horizontally adjacent abutting blocks forming a first seam stacked on two horizontally adjacent abutting blocks forming a seam offset from the other seam with a seam post within the blocks with both seams intermediate the width of the seam post.
Figure 5:
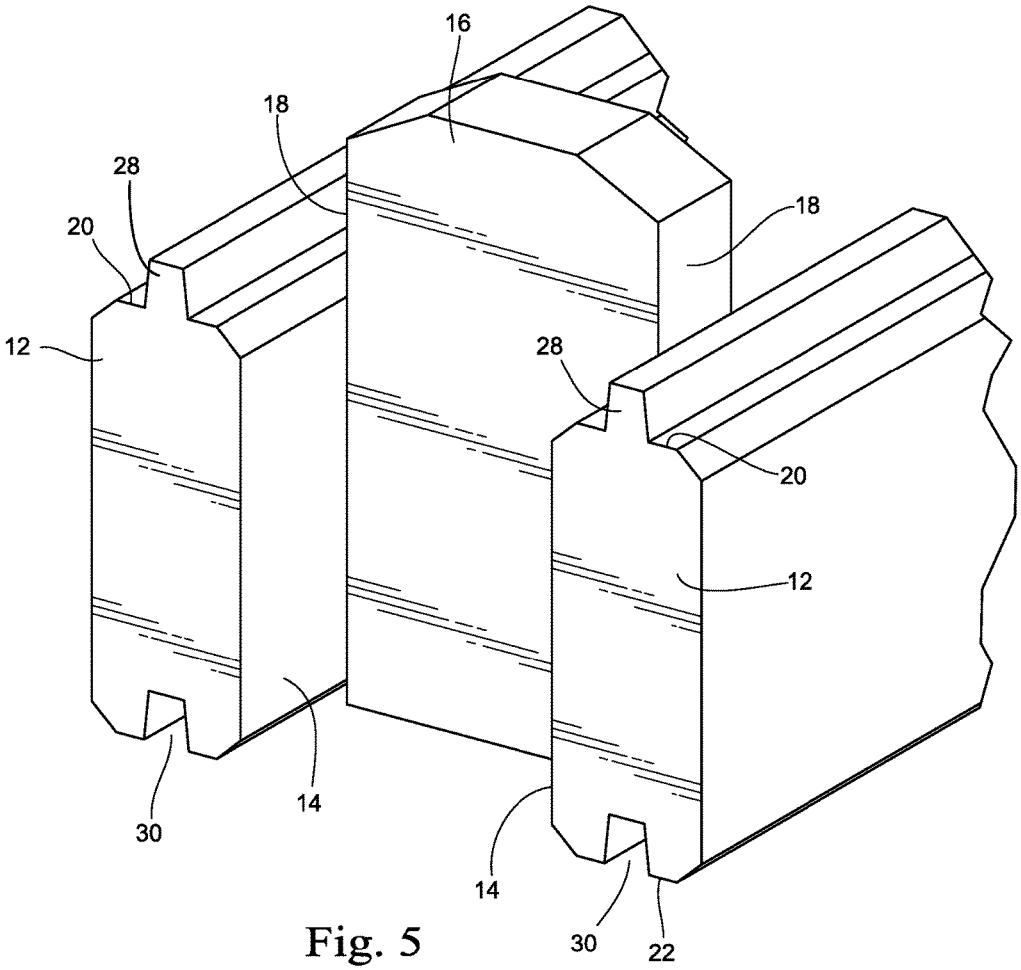
FIG. 5 is an end perspective view of the block of the present invention.
Figure 6:
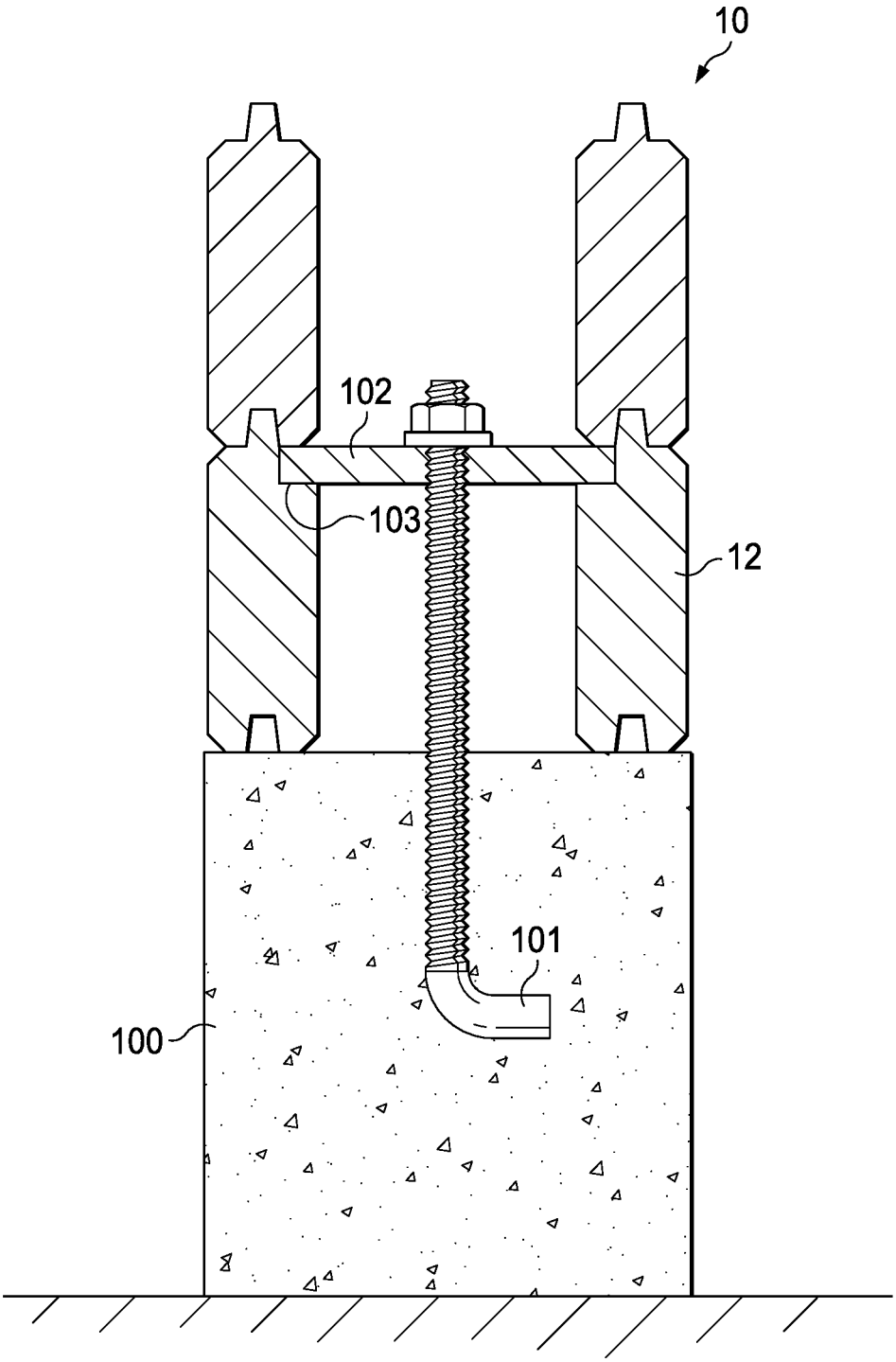
FIG. 6 is a cut view of an optional anchor for a wall.
Figure 7:
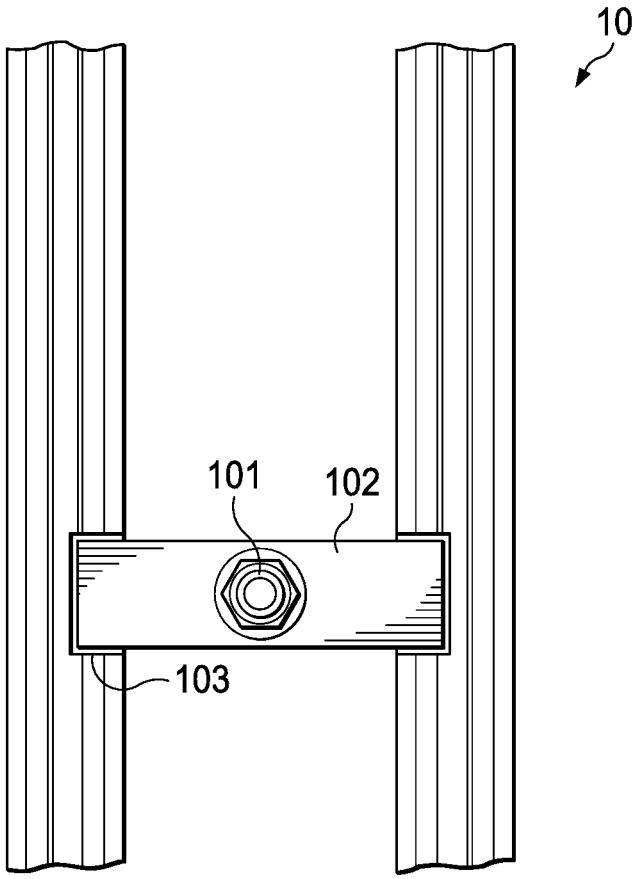
FIG. 7 is a top view of an optional anchor for a wall.
Figure 8:
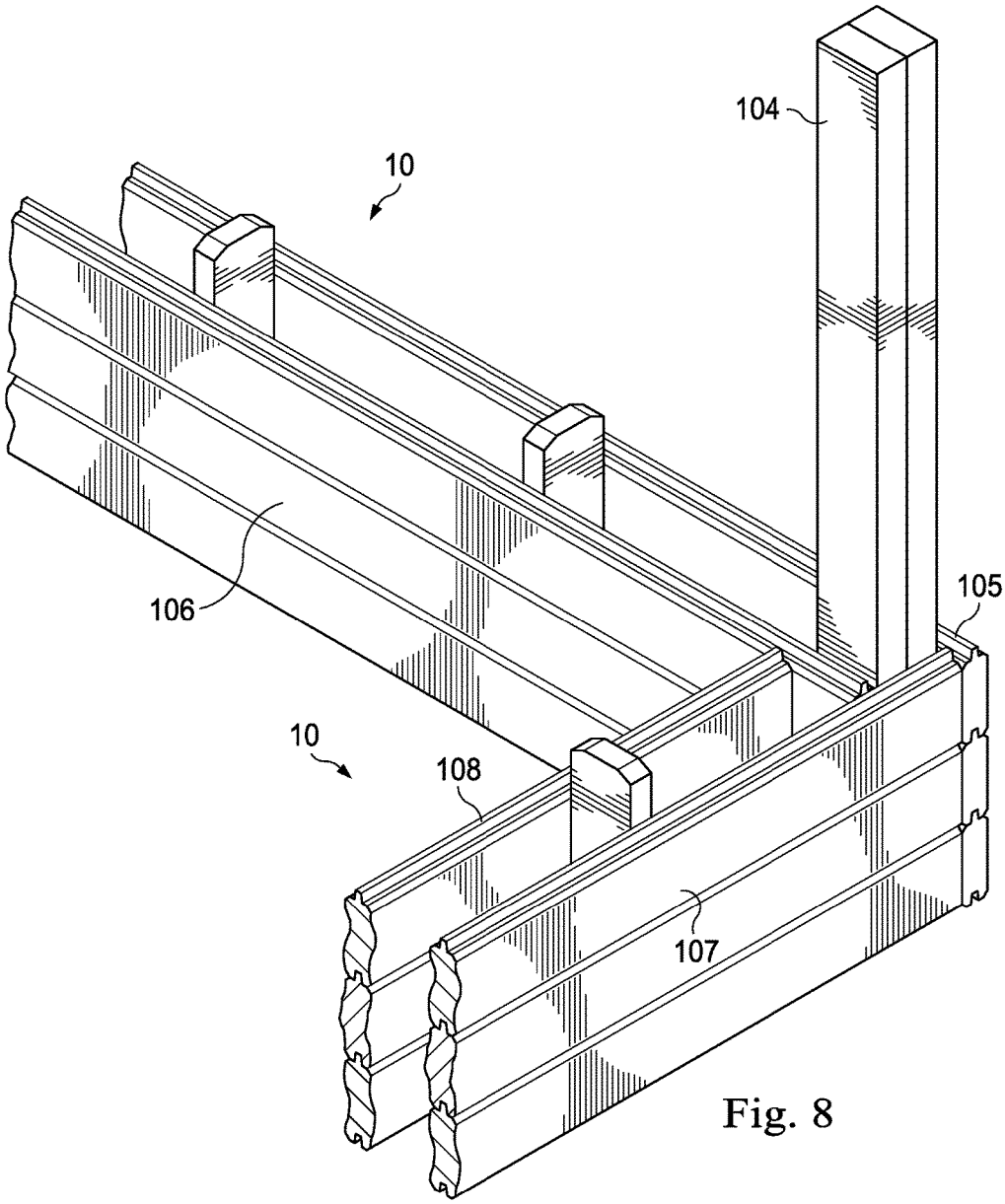
FIG. 8 is a perspective view of a corner of a wall.
Figure 9:
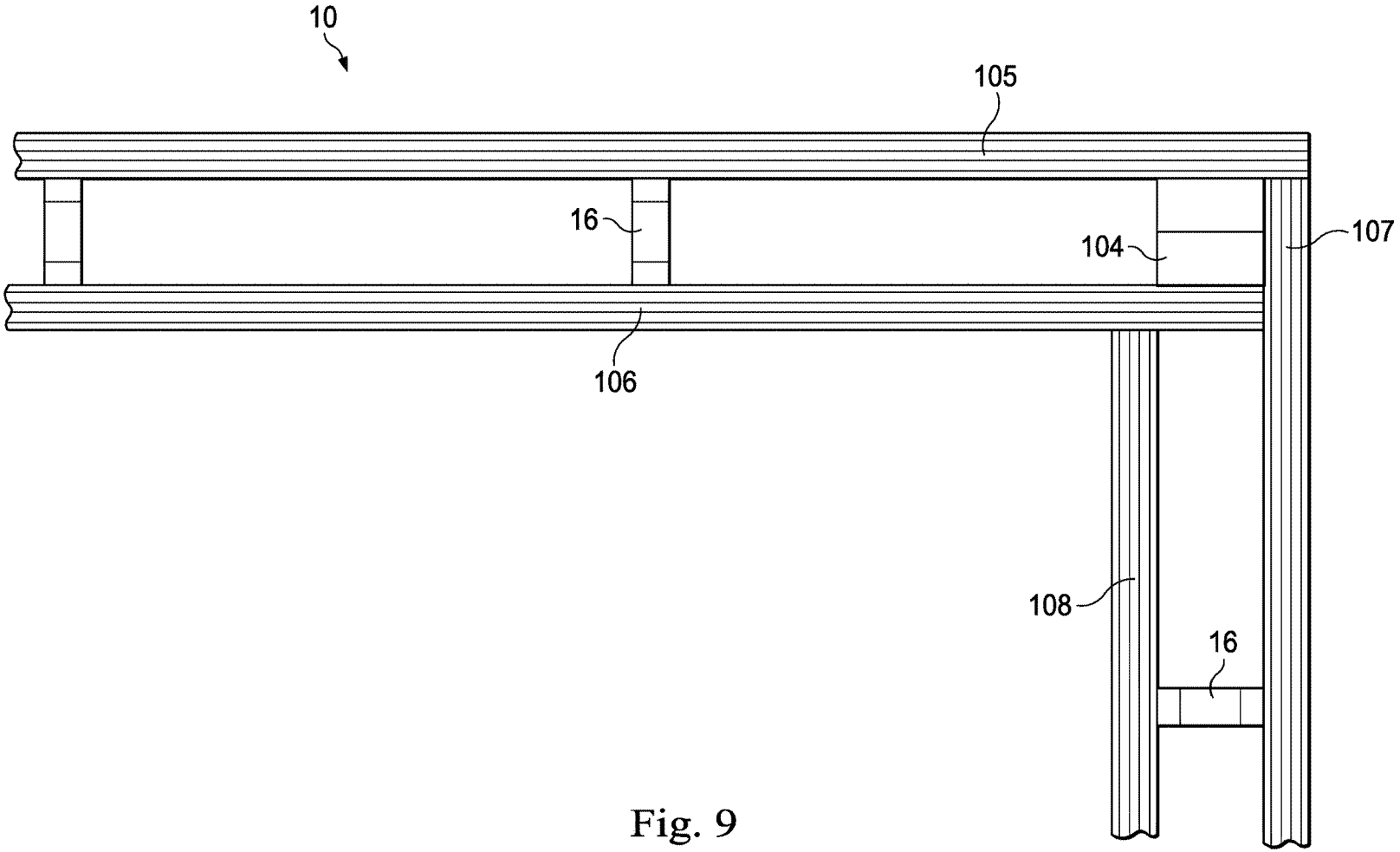
FIG. 9 is a top view of a corner of a wall.

The block 10 for wall construction of the present invention comprises a pair of outer members 12 with flat inner surfaces 14 spaced apart by and in flat face to face contact with at least two risers 16 spaced apart between outer members 12, the risers 16 also having vertical flat surfaces 18 matching the inner surfaces 14 of the outer members 12. The construction results in the block 10 open at its top 20 and bottom 22 and with a void center 24 between outer members 12 and risers 16. The risers 16 extend from the bottom 22 of the block 10 vertically to a height substantially above the outer members 12 with its flat surfaces 18 also continuing beyond the top 20 of the outer members 12, adapted to slidably receive a similar second block 10' stackable thereon and over the extended risers 16 with the extended risers 16 extending into the center 24' of the second block 10'. With the vertically extending risers 16 extending into the center 24' of the second block 10', the riser flat surfaces 18 extending above the block 10 are also in face to face contact with inner surfaces 14' of the outer members 12 of the second block 10' when stacked thereon, connecting the two vertically stacked blocks 10, 10'. A nail 26 is then driven through the outer members 12 of the stacked block 10' into the risers 16 of the block 10 on which it is stacked thus permanently connecting the two blocks 10, 10' together. Clearly, a screw may substitute for the nail, both as fasteners connecting the blocks. The block 10 further comprises a tongue 28 extending upward on the top 20 of at least one outer member 12 longitudinally therewith and a groove 30 on the bottom 22 of the at least one outer member 12 into which the tongue 28 of a similar outer member 12' may be received. The groove 30 is typically slightly larger in width than the tongue 28 for ease of assembly.

Typically in stacking the blocks 10 for a wall construction, blocks 10 are stacked such that ends 34 of horizontally adjacent blocks 10*a*, 10*b* abutting internal the wall forming a seam 36 are offset with next vertically stacked blocks 10*c*, 10*d* likewise forming a seam 36' to avoid a vertical seam on seam joint between stacked blocks at abutting block ends 34. A seam post 40 is insertable vertically between pairs of horizontally adjacent blocks 10*a*, 10*b*. The seams 36 of vertically adjacent blocks 10, 10' are assembled such that the seams 36 lie intermediate the post 40 such that the post 40 closes the seams 36.

A plurality of blocks 10 are stackable forming a wall 42 with open block ends 44 at a wall end 46. An end post 48 is provided insertable in ends 44 of stacked blocks at the wall end 46 closing the block ends 44, suitable for interfacing with a window or a door. The end post 48 also is suitable to support a header for the window or door.

The void center of a wall may be filled with an insulation which is preferably a closed cell foam. The closed cell foam adheres the blocks 10 together and forms strong wall. The space between the tongue 28 and slightly larger groove 30 of stacked blocks may be filled with adhesive which further strengthens the wall.

A further improvement in the field of wall construction is a method and apparatus for anchoring the block wall 42 to a foundation 100. Anchor bolts 101 can be cured into a concrete foundation 100 or attached to a pier block 100. The anchor bolt is threaded on one end to allow fastening. A plurality of blocks 10 forming a first course of blocks are fixed to the foundation through anchor bolts 101. A recess 103 is formed in the top of adjacent outer members 12 configured to fit an anchor plate 102 that spans across the void center 24. The recess 103 depth is configured to allow the anchor plate 102 to sit below the top 20. This allows the next course of blocks to sit flush. The anchor bolt 101 is received through an aperture in the anchor plate 102 and secured. Anchor bolts 101 are spaced around the foundation to obtain the desired strength at the interface of the wall 42 and the foundation 100.

Advantageously, a corner post 104 is inserted in the void center 24 at a corner where two walls 42 meet. It has been found that because blocks 10 have a groove 30 slightly larger in width than the tongue 28 that a wall may not be planar when initially stacked. Having a corner post 104 driven in immediately lines up all the blocks 10 for a planar wall 42 that is pleasing to look at. The corner post 104 may be put in place initially and blocks 10 stacked around it to yield the same result.

A preferable corner stacking pattern for a single course of blocks 10 is a first wall exterior member 105 extends to the corner and is the longest outer member 12. A second wall exterior member 107 abuts perpendicular to the first wall exterior member 105. The first wall interior member 106 abuts perpendicular to the second wall exterior member 107. The second wall interior member 108 abuts perpendicular to the first wall interior member 106. Fasteners can then be installed through the exterior members into the corner post.

Another corner pattern for a single course of blocks 10 may be a first wall exterior member 105 extends to the corner and is the longest outer member 12. A second wall exterior member 107 and the second wall interior member 108 abut perpendicular to the first wall exterior member 105.

The first wall interior member 106 abuts perpendicular to the second wall interior member 108. Fasteners can then be installed through the exterior members into the corner post.

Figure 10:
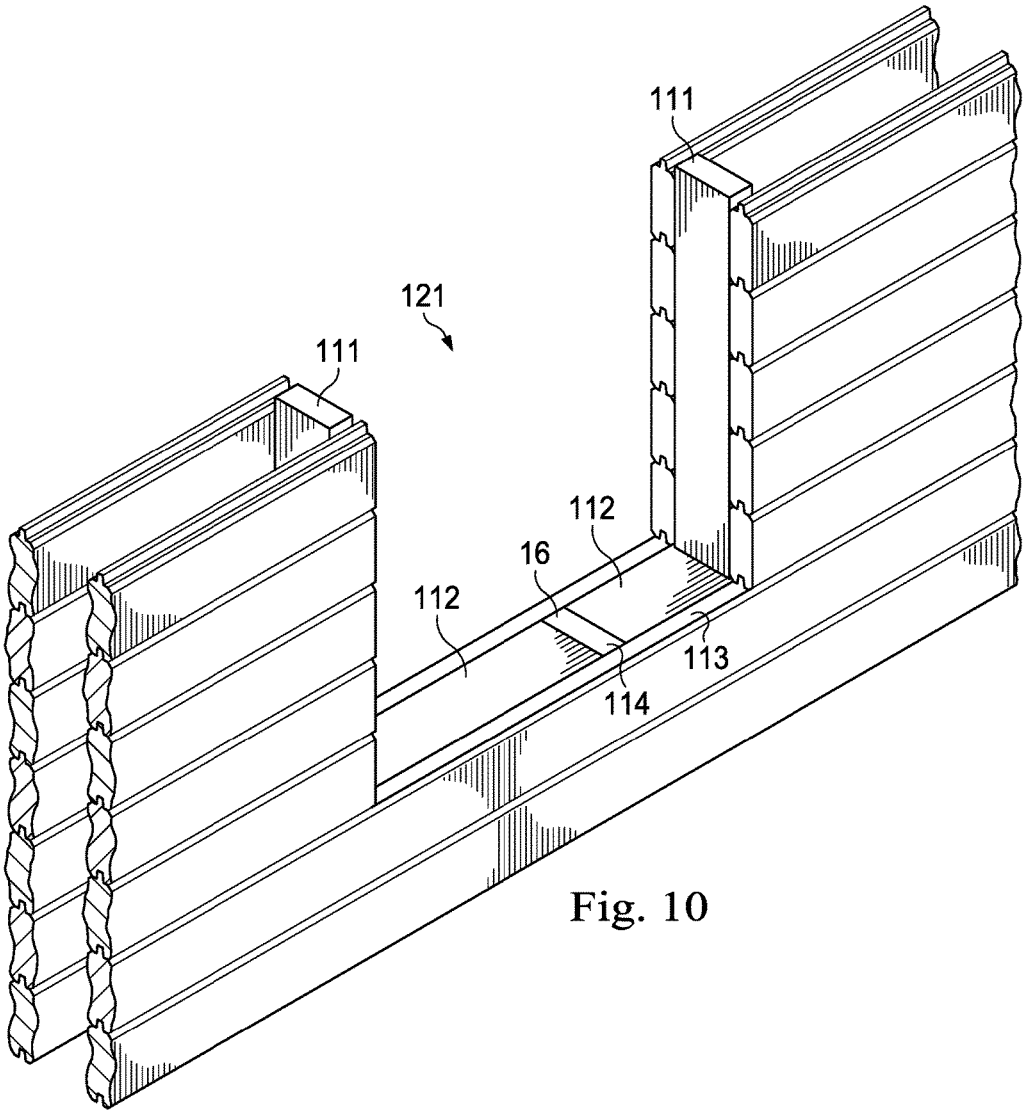
FIG. 10 is a perspective view of a wall with a window opening.

As seen in FIG. 10, it may be desirable to put a window in a block wall. The block 10 that is the lower surface of a window opening 121 may be modified to accept a window by adapting a typical block to have a flush portion 113. The flush portion 113 doesn't have a tongue 28 preferably due to being removed or due to not being machined originally. If the block 10 that is the lower surface of a window opening 121 has a riser within the opening of the window then, it must be a flush riser 114. The flush riser 114 is preferably machined flush or made originally flush. The void center is closed using a horizontal sill closeout 112 which fits into the void center between flush portions 113 of the outer members 12. Horizontal sill closeouts 112 span the window opening or extend away from the flush riser 114 in both directions to the edge of the window opening 121. Vertical sill closeouts 111 fit flush into the void center of blocks that end at the window opening 121 and provide, like the horizontal closeout 112, a flush, closed surface to mount a window to.

Figure 11:
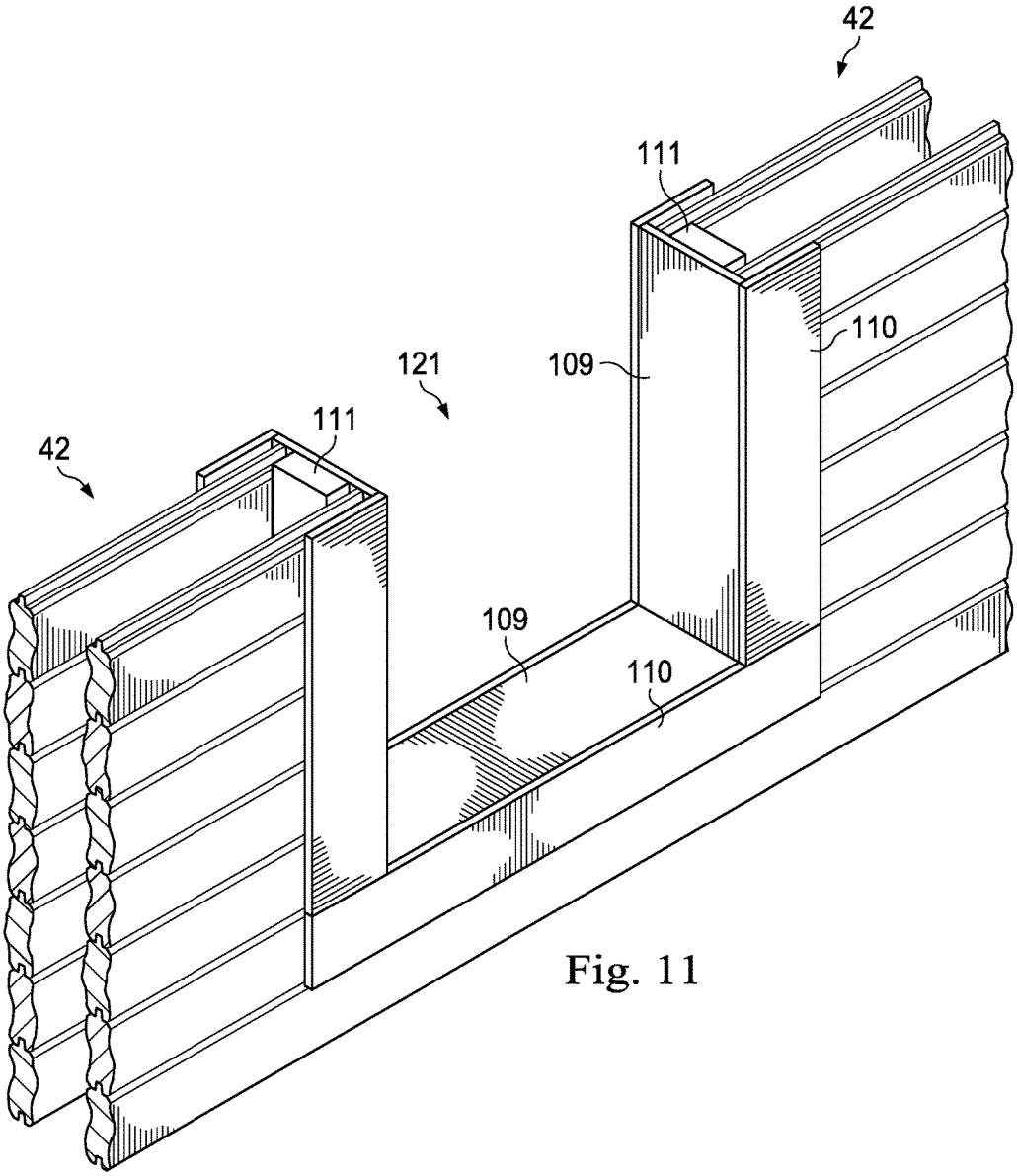
FIG. 11 is a perspective view of a wall with a window opening and an optional finish wrap.

As seen in FIG. 11, it may be undesirable to see the cut ends of boards. Therefore it may be desirable to wrap all corners and openings with finish quality material. Window opening 121 may have a wrap closeout piece 109 over the closeouts 111 and 112. A framing wrap 110 finishes up the window opening 121 by covering seams between closeout wraps 109 and block wall 42.

Figure 12A:
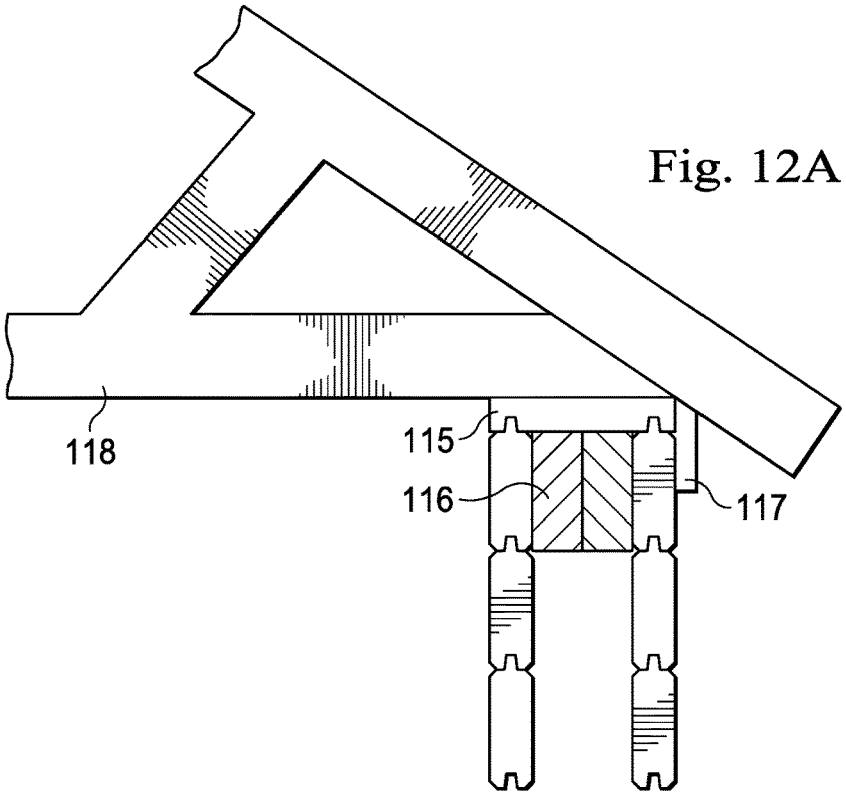
FIG. 12A is a side cut view of a portion of a wall with a rafter resting on top of it.
Figure 12B:
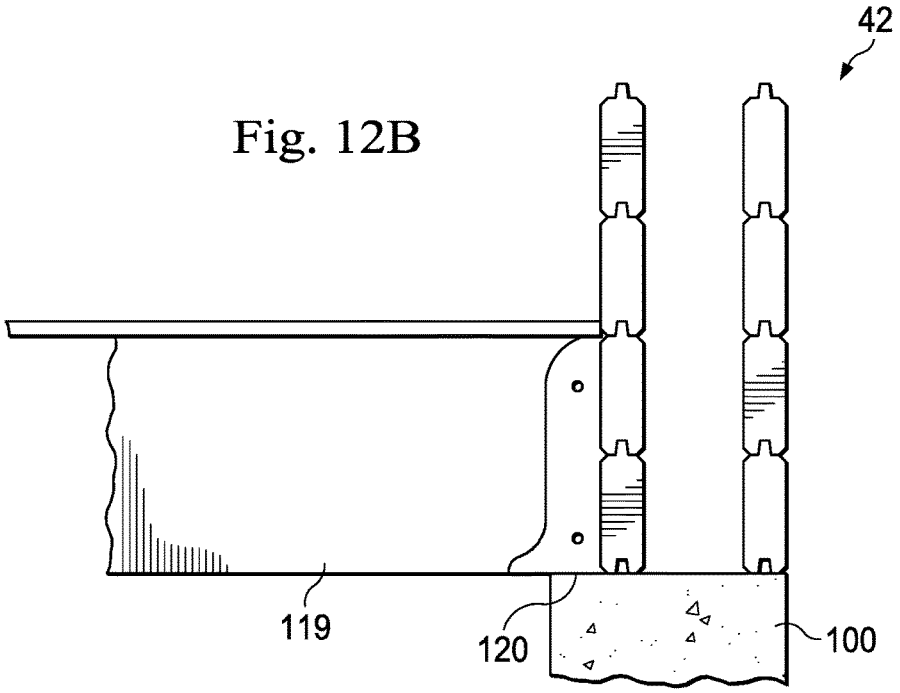
FIG. 12B is a side cut view of a portion of a wall resting on a foundation with a floor joist attached to it.

As seen in FIG. 12, the wall 42 interfaces with a foundation 100, a floor joist 119 and a rafter 118. A preferable joist attachment allows a joist to sit on a foundation ledge 120 and is attached to the wall 42 with a joist hanger or direct attachment. The top of the wall 42 is closed out with preferably two spacer blocks between the risers all along the top of the wall. A wall cap 115 may have grooves that fit over the tongues in wall 42. Preferably fasteners are driven through the wall cap 115 into the spacer blocks 116. A rafter 118 then sits atop the wall cap 115. A trim board 117 covers the seams between rafter 118, wall cap 115 and block wall 42.

I claim:

1. A wall comprising: a first block including, a pair of outer members comprising boards, spaced apart by at least two risers spaced inward from respective outer member ends forming a void center between the outer members and the at least two risers, wherein the risers are coupled to the outer members by nails, wherein, the first block is open at its top and bottom with the at least two risers having vertical surfaces extending above the outer members, the outer members having vertical flat inner surfaces in face to face contact with the vertical riser surfaces that extend with the at least two risers extending above the outer members, a similar second block slidably receiving the at least two risers of the first block in face to face contact with inner surfaces of the second block as the at least two risers extend into a center of the second block and, a recess in the pair of outer members of the first block, an anchor plate recessed into the pair of outer members of the first block such that the first block can be anchored to a foundation.

2. The wall of claim 1 wherein the second block when stacked vertically adjacent on the first block receives the risers of the first block extending into the center of the second block offset from the risers of the first block.

3. The wall of claim 1 wherein the blocks comprise a tongue extending upward on a top of at least one outer member longitudinally therewith and a groove on a bottom of at least one outer member into which a tongue of a similar outer member may be received.

4. The wall of claim 3 in which the groove on a bottom of the pair of outer members is slightly larger in width than the tongue extending upward on a top of the pair of outer members to accommodate manufacturing tolerances.

5. The wall of claim 1 further comprising, a foundation ledge configured to support a floor joist.

6. The wall of claim 1 further comprising, a wall cap configured to close a wall top and support a rafter.

7. The wall of claim 1 further comprising:

a corner post configured to fit into an intersection of a first and second wall.

8. The wall of claim 7 wherein, a second wall exterior member abuts perpendicular to a first wall exterior member and a first wall interior member abuts perpendicular to the second wall exterior member and a second wall interior member abuts perpendicular to the first wall interior member.

9. The wall of claim 7 wherein, a first wall exterior member extends to a corner and a second wall exterior member and a second wall interior member abuts perpendicular to the first wall exterior member and a first wall interior member abuts perpendicular to the second wall interior member.

10. The wall of claim 7, wherein the second block when stacked vertically adjacent on the first block receives the risers of the first block extending into the center of the second block offset from the risers of the first block.

11. The wall of claim 7 further comprising an insulation filling the void center.

12. The wall of claim 7 wherein the blocks comprise a tongue extending upward on a top of at least one outer member longitudinally therewith and a groove on a bottom of at least one outer member into which a tongue of a similar outer member may be received.

13. The wall of claim 12 in which the groove on a bottom of the pair of outer members is slightly larger in width than the tongue extending upward on top of the pair of outer members to accommodate manufacturing tolerances.

14. The wall of claim 1 further comprising:

a window opening having, a vertical sill closeout and a horizontal sill closeout.

15. The wall of claim 14 comprising, a wooden wrap closeout interior to the window opening and, a wooden wrap framing around the widow opening.

16. The wall of claim 14 wherein, the window opening comprises a block having a flush portion, wherein the flush portion is a pair of outer members not comprising a tongue extending upward on top of the pair of outer members.

17. The wall of claim 14 wherein, the window opening comprises a block having a flush riser, wherein the flush riser is a riser that does not extend above the pair of outer members.

18. The wall of claim 14 wherein the blocks comprise a tongue extending upward on the top of at least one outer member longitudinally therewith and a groove on the bottom of the bottom of the at least one outer member into which the tongue of a similar outer member may be received.

19. The wall of claim 18 wherein an adhesive fills the groove of one outer member and couples to the tongue of another outer member.

20. The wall of claim 1 wherein, the recess has a depth configured to allow the anchor plate to sit below the top of the outer members, allowing the second block to sit flush, wherein an anchor bolt is received through an aperture in the anchor plate and, a close out board being put in the void center flush with a vertical edge of an opening to make a flush surface.

* * * * *